US011736846B2

(12) United States Patent
Zhang et al.

(10) Patent No.: US 11,736,846 B2
(45) Date of Patent: Aug. 22, 2023

(54) EARPHONE

(71) Applicant: GOERTEK INC., Weifang (CN)

(72) Inventors: Jie Zhang, Weifang (CN); Zhongxu Zhao, Weifang (CN); Zaikang Guo, Weifang (CN)

(73) Assignee: GOERTEK INC., Weifang (CN)

( * ) Notice: Subject to any disclaimer, the term of this patent is extended or adjusted under 35 U.S.C. 154(b) by 86 days.

(21) Appl. No.: 17/451,588

(22) Filed: Oct. 20, 2021

(65) Prior Publication Data

US 2022/0116694 A1 Apr. 14, 2022

Related U.S. Application Data

(63) Continuation of application No. PCT/CN2019/130466, filed on Dec. 31, 2019.

(30) Foreign Application Priority Data

Dec. 20, 2019 (CN) ..... 201911342016.X

(51) Int. Cl.
*H04R 25/00* (2006.01)
*H04R 1/10* (2006.01)

(52) U.S. Cl.
CPC ..... *H04R 1/1008* (2013.01); *H04R 1/105* (2013.01); *H04R 2420/07* (2013.01)

(58) Field of Classification Search
CPC ..... H04R 1/2849; H04R 1/1016; H04R 2420/07; H04R 2499/11
See application file for complete search history.

(56) References Cited

U.S. PATENT DOCUMENTS 4,742,887 A * 5/1988 Yamagishi ..... H04R 1/22 381/372

FOREIGN PATENT DOCUMENTS

| | | | |
|---|---|---|---|
| CN | 1259005 | A | 7/2000 |
| CN | 101198194 | A | 6/2008 |
| CN | 104010241 | A | 8/2014 |
| CN | 108718430 | A | 10/2018 |
| CN | 110191386 | A | 8/2019 |
| CN | 110476438 | A | 11/2019 |
| CN | 209659534 | U | 11/2019 |
| EP | 1931170 | A2 | 6/2008 |
| WO | 2017204574 | A1 | 11/2017 |

OTHER PUBLICATIONS

First Office Action issued in corresponding Chinese Application No. 201911342016.X; dated Jul. 27, 2020; State Intellectual Property Office of the P.R. China, Beijing, China, 13 pgs.

(Continued)

*Primary Examiner* — Amir H Etesam
(74) *Attorney, Agent, or Firm* — Hauptman Ham, LLP

(57) ABSTRACT

Disclosed is an earphone, which includes a housing defined with a first sound hole, a second sound hole, and a resonant cavity communicating the first sound hole and the second sound hole inside the housing; and a loudspeaker in the resonant cavity, having a first sound emitting surface corresponding to the first sound hole, and a second sound emitting surface facing the first sound emitting surface, where sound emitted from the second sound emitting surface pass to the second sound hole through the resonant cavity.

14 Claims, 8 Drawing Sheets

(56) References Cited

OTHER PUBLICATIONS

Second Office Action issued in corresponding Chinese Application No. 201911342016.X; dated Jan. 26, 2021 State Intellectual Property Office of the P.R. China, Beijing, China, 12 pgs.
Third Office Action issued in corresponding Chinese Application No. 201911342016.X; dated Apr. 23, 2021; State Intellectual Property Office of the P.R. China, Beijing, China, 11 pgs.
International Search Report and Written Opinion issued in PCT/CN2019/130466; dated Sep. 30, 2020;11 pgs.

* cited by examiner

EARPHONE

CROSS-REFERENCE TO RELATED APPLICATIONS

The present disclosure is a continuation application of International Application No. PCT/CN2019/130466, filed on Dec. 31, 2019, which claims priority to Chinese Patent Application No. 201911342016.X, filed on Dec. 20, 2019, entitled "Earphone", the entire disclosures of which are incorporated herein by reference.

TECHNICAL FIELD

The application relates to the technical field of earphones, in particular to an earphone.

BACKGROUND

Under heavy workload, users may have earphones for their life-enjoying moments at their will, and earphones have been increasingly demanded nowadays. However, it typically requires the users to insert the earphone plugs into their ears, and that may cause discomfort such as ear distending and ear pressing when wearing the earphone plugs for a long time.

The aforementioned is assistant in understanding the technical solution of the present disclosure, and does not necessarily admit that the aforementioned constitutes the prior art.

SUMMARY

For above, it is necessary to provide an earphone which can be suitably worn by the user for a long time without feeling any discomfort such as ear distending and ear pressing, and to solve the problem that the existing earphones require the user to insert the earphone plugs into the ear, which may easily induce discomfort such as ear distending and ear pressing when wearing them for a long time.

For the above object, the present disclosure provides an earphone, which includes:

a housing, defined with: a first sound hole, a second sound hole, and a resonant cavity communicating the first sound hole and the second sound hole inside the housing; and a loudspeaker in the resonant cavity, including: a first sound emitting surface corresponding to the first sound hole, and a second sound emitting surface opposite to the first sound emitting surface, where sound emitted from the second sound emitting surface is passed to the second sound hole through the resonant cavity.

Optionally, a cavity length L of the resonant cavity satisfies: $L=(1+2k)*85/f$, where k is an integer, and f is an upper limit of a muffling frequency.

Optionally, an equivalent diameter of the resonant cavity is R, then L is larger than 10 times of R.

Optionally, the earphone has a partition inside the housing, where the partition and an inner wall of the housing enclose and form the resonant cavity.

Optionally, the partition includes a first portion, a second portion, and a connecting portion connecting the first portion and the second portion, the first portion, the second portion and the connecting portion, and the inner wall of the housing enclosing and forming the resonant cavity;

the first portion is disposed adjacent to the first sound hole, and the second portion is disposed adjacent to the second sound hole.

Optionally, the first sound hole and the second sound hole are on an upper surface of the housing, and the connecting portion includes a first section connected with the first portion and a second section connected with the second portion, the first portion and the first section form an installation room for accommodating the loudspeaker.

Optionally, a distance from the first section to an inner top wall of the housing is greater than a distance from the second section to the inner top wall of the housing.

Optionally, a length of the second section is greater than a length of the first section.

Optionally, the housing includes a housing body in an arc shape, and installation sections extending from two ends of the housing body, the first sound hole and the second sound hole being defined on each of the installation sections, and the resonant cavity being arranged in the installation sections.

Optionally, the first sound hole is defined at each of the installation sections close to the housing body, and the second sound hole is defined at each of the installation sections away from the housing body.

According to the technical solution provided by the present disclosure, the earphone is worn at the neck of the user. That is, the earphone is hung at the neck of the user without directly contacting with human ears. A first sound hole and a second sound hole are arranged on the surface of the housing, and a resonant cavity is arranged communicating the first sound hole and the second sound hole. By arranging a loudspeaker which enables to propagate sound in two directions, the sound emitted by the first sound emitting surface transmits through the first sound hole, and also passes through the resonant cavity and transmits through the second sound hole. The sounds from the first sound hole and the second sound hole are superimposed before propagating into the users' ears. As such, it avoids the user to insert the earphones into their ears for sound acquisition. The user will feel no ear distending and ear pressing, even if the earphone is worn for a long time.

BRIEF DESCRIPTION OF THE DRAWINGS

In order to explain the embodiment of the present disclosure or the technical solution of the related art more clearly, the following will briefly introduce the drawings necessary in the description of the embodiments or the prior art. Obviously, the drawings in the following description are only a part of the drawings of the present disclosure. For those ordinary skilled in the art, other drawings can be obtained based on the existing drawings without any creative effort.

Figure 1:
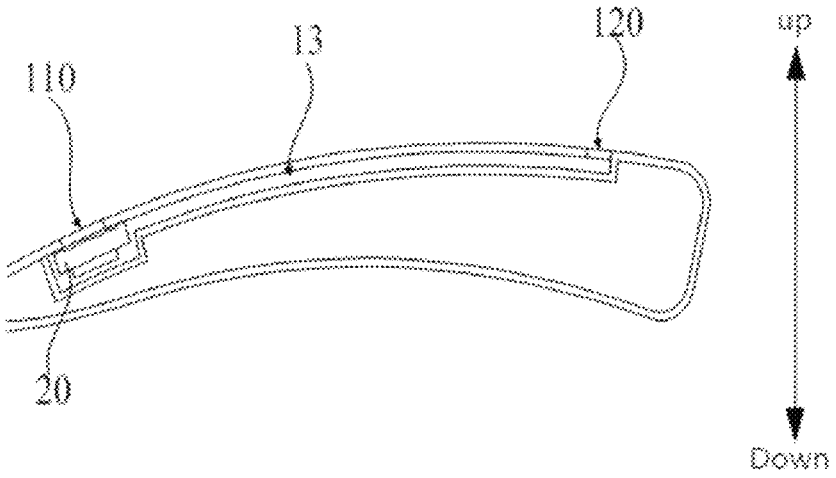
FIG. 1 is a schematic cross sectional view of a part of an earphone according to the present disclosure.

The implementation, functional characteristics and advantages of the present disclosure will be further described with reference to the attached drawings in combination with embodiments.

DETAILED DESCRIPTION OF THE EMBODIMENTS

As following, the technical solution in the embodiments of the present disclosure will be described clearly and completely with reference to the drawings in the embodiment of the present disclosure. Obviously, the described embodiment is only a part of the embodiment of the present disclosure, not all of the embodiments. Based on the embodiments in the present disclosure, all other embodiments perceived by those ordinary skilled in the art without creative effort should be fallen within the protection scope of the present disclosure.

It should be noted that all directional indicators in the embodiment of the present disclosure are only used to explain the relative positional relationship, movement, etc. between various components under a certain specific posture (as shown in the drawings). If the specific posture changes, the directional indicator will also change accordingly.

In addition, the descriptions related to "first", "second" and the like in the present disclosure are for descriptive purposes only and cannot be understood as indicating or implying its relative importance or implicitly indicating a number of technical features indicated. Thus, features defining "first" and "second" may explicitly or implicitly include at least one of the features. In the description of the present disclosure, the meaning of "plural" is at least two, such as two, three, etc., otherwise specifically defined.

In the present disclosure, the terms "connected" and "fixed" etc. should be understood in a broad sense, otherwise specified and defined. For example, "fixed" can be a fixed connection, a detachable connection, or a forming a part integrally. It can be a mechanical connection or an electrical connection. It can be a direct connection or an indirect connection through an intermediate medium. And it can be the communication between interior of two elements or the interaction between two elements, otherwise specifically defined. For those ordinary skilled in the art, the specific meanings of the aforementioned terms in the present disclosure can be understood according to practical conditions.

In addition, the technical solutions between the various embodiments may be combined with each other, but must be based on what one of ordinary skill in the art can achieve. When the combination of technical solutions is contradictory or impossible to achieve, it should be considered that the combination of such technical solutions does not exist and is not within the protection scope required by the present disclosure.

Figure 2:
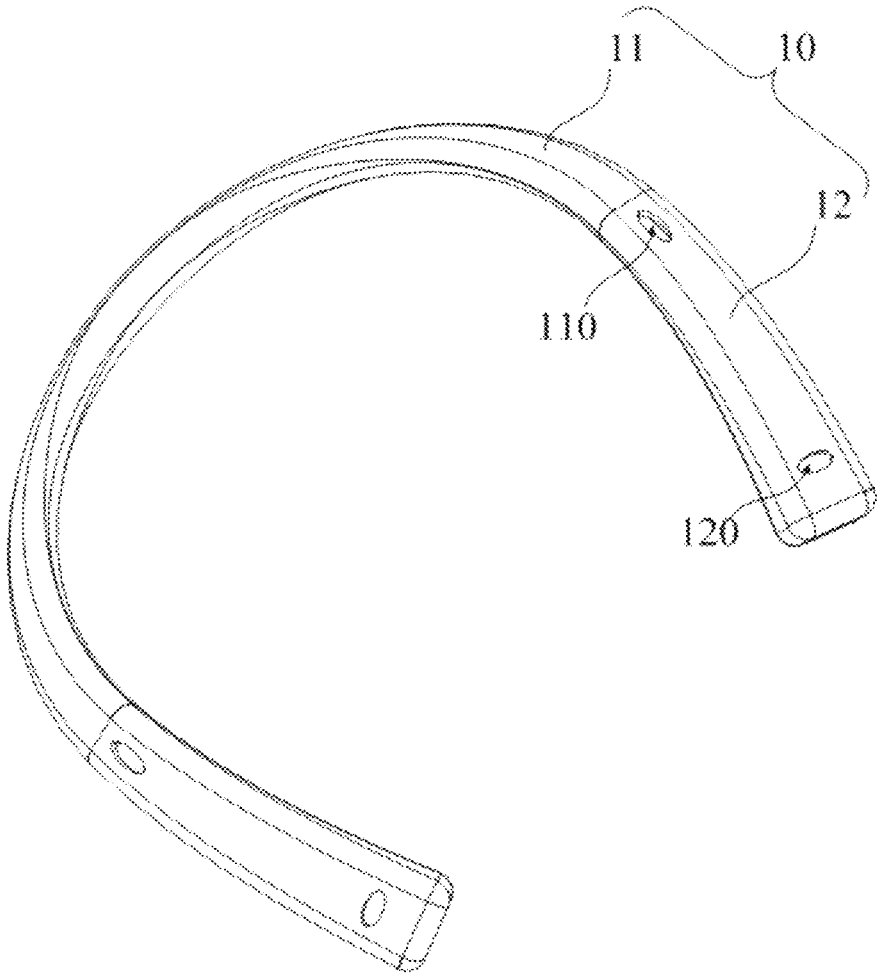
FIG. 2 is a structural schematic view of an earphone according to an embodiment of the present disclosure.
Figure 3:
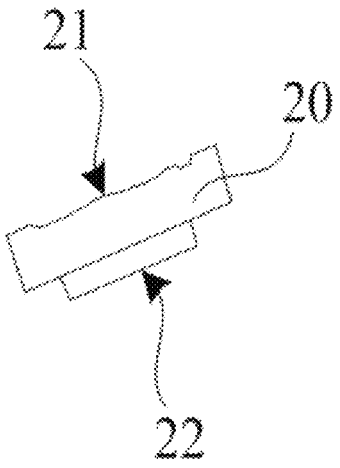
FIG. 3 is a structural schematic view of a loudspeaker of the earphone in FIG. 1.

Referring to FIGS. 1 to 3, the earphone in the present disclosure includes a housing 10 and a loudspeaker 20.

A first sound hole 110 and a second sound hole 120 are formed on the surface of the housing 10, and a resonant cavity 13 communicating with the first sound hole 110 and the second sound hole 120 is formed inside the housing 10. When a user enjoys music with the earphone, the housing 10 is typically hung at the neck of the user. The earphone has various electronic components such as a circuit board and a battery connected with the circuit board in the housing 10.

In which, the opening of the first sound hole 11 and the second sound hole 12 can be optional in their shape. For example, these holes can be round, oval, square or strip, etc. The main functions of the first sound hole 110 and the second sound hole 120 are to ensure that the sound emitted by the loudspeaker 20 can be propagated. In addition, a resonant cavity 13 communicating with the first sound hole 110 and the second sound hole 120 is provided inside the housing 10. The resonant cavity 13 is also called a sympathetic vibration cavity, and the sound emitted by the loudspeaker 20 propagates in the resonant cavity and passes out through the second sound hole 120. The length of the resonant cavity 13 can be designed to control the propagation distance of sound in the resonant cavity 13. A phase difference can be generated in sound propagated between the first sound hole 110 and the second sound hole 120. It may further ensure that the user can enjoy music at the position where the sound is enhanced, while or at other positions the sound is weakened.

The loudspeaker 20 is arranged in the resonant cavity 13 at a position corresponding to the first sound hole 110. For example, the loudspeaker 20 may be pasted or welded in the resonant cavity 13. The loudspeaker 20 includes a first sound emitting surface 21 corresponding to the first sound hole 110, and a second sound emitting surface 22 facing away from the first sound emitting surface 21. The sound emitted by the second sound emitting surface 22 is transmitted to the second sound hole 120 through the resonant cavity 13. In addition, the loudspeaker 20 is arranged corresponding to the first sound hole 110. It can be appreciated that the first sound emitting surface 21 of the loudspeaker 20 is arranged facing to the opening of the first sound hole 110.

In the technical solution proposed in the present embodiment, the earphone is worn at the neck of the user. That is, the earphone is hung at the neck of the user, and a first sound hole 110 and a second sound hole 120 are formed on the surface of the housing 10, where the first sound hole 110 and the second sound hole 120 are open sound holes. Compared with the related art, the sound holes of the earphone are directly inserted into the human ears. That is, the present solution can avoid discomfort such as ear distending and ear pressing. A resonant cavity 13 is arranged communicating the first sound hole 110 and the second sound hole 120. By arranging a loudspeaker 20 which enables to propagate sound in two directions, the sound emitted by the first sound emitting surface 21 transmits through the first sound hole 110, and the sound emitted by the second sound emitting surface 22 transmits through the second sound hole 120. The sounds from the first sound hole 110 and the second sound hole 120 are superimposed before propagating into the users' ears. As such, it avoids the user to insert the earphones into their ears for sound acquisition. The user will feel no ear distending and ear pressing, even if the earphone is worn for a long time.

Figure 4:
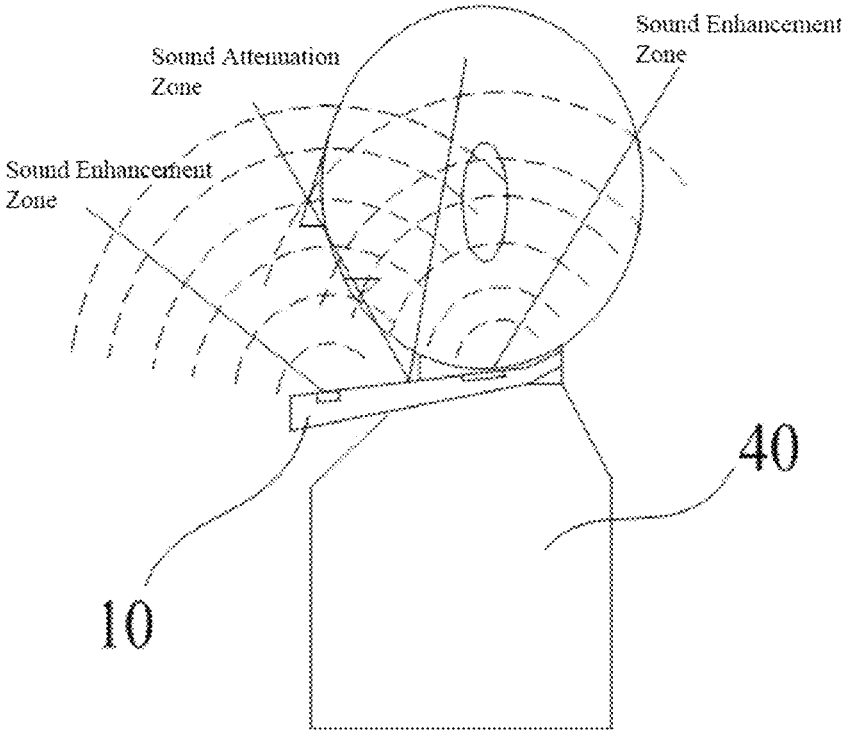
FIG. 4 is a schematic diagram showing an enhancement zone and an attenuation zone formed when a user wears an earphone according to the present disclosure.
Figure 5:
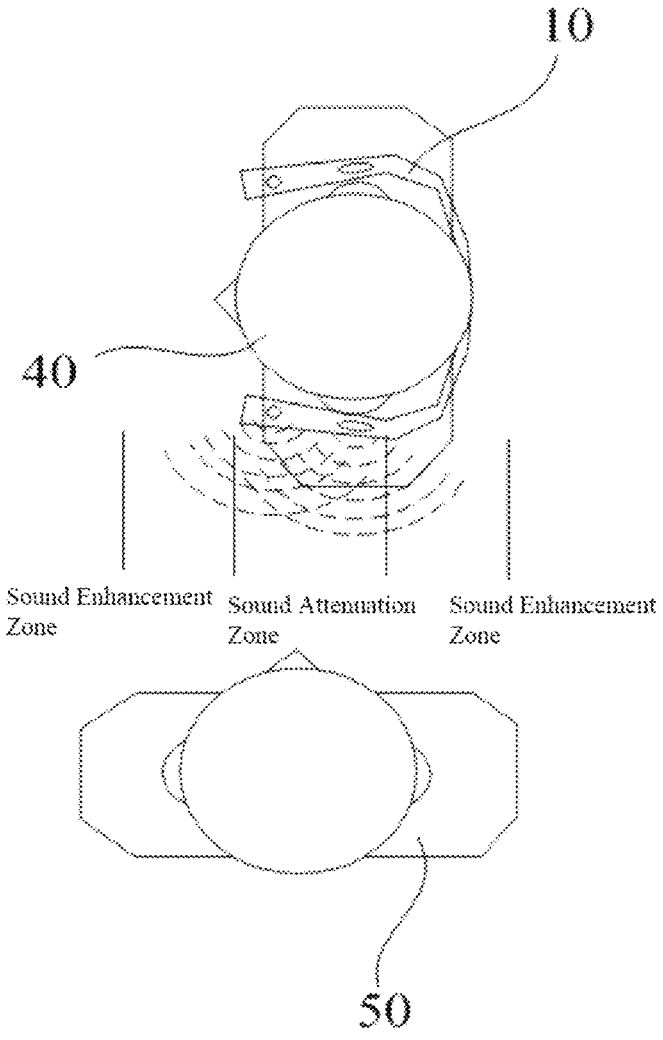
FIG. 5 is a schematic diagram showing how a user and a third party receives the sound.
Figure 6:
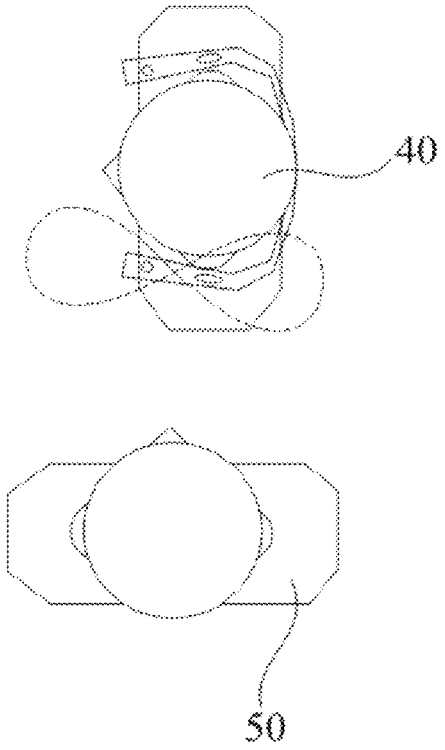
FIG. 6 is a schematic diagram showing directions of the sound received by the user and the third party in FIG. 5.

Further, a cavity length L of the resonant cavity satisfies: $L=(1+2k)*85/f$, where k is an integer, and f is the upper limit of the muffling frequency. When a shape of the resonant cavity 13 are arranged as a strip, the cavity length of the resonant cavity 13 is the distance from the first sound hole 110 to the second sound hole 120. That is, the distance between the first sound hole 110 and the second sound hole 120 is the propagation distance of sound waves in the resonant cavity 13. When the resonant cavity 13 is bent, the cavity length L is the propagation distance of sound waves in the resonant cavity 13. For example, taking an example that the resonant cavity 13 is strip-shaped, and the user uses the earphone, there exists a distance difference for the distance from the first sound hole 110 to the user's ears, compared to that from the second sound hole 120 to the user's ears. Therefore, in order to ensure that a clear sound is received by the user's ears, it is necessary to make sure that the sounds transmitted from the first sound hole 110 and the second sound hole 120 overlap each other in amplitude, while the sound received by a third person who is positioned around the user is reduced or make sure to disable the third person near by to hear clearly of the sound emitted by the earphone. Specifically, as shown in FIGS. 4 and 5, for the cavity length L of the resonant cavity 13, the sound intensity I received by the user is calculated as:

$$I = \frac{|A|^2 \times k^2 \times L^2}{2\rho_0 c_0 r^2} \times \cos^2\theta.$$

Where A is a constant, $c_0$ is the speed of sound; $p_0$ is the medium density for transmitting sound waves; r is the distance between the user and the midpoint of the line connecting between the first sound hole 110 and the second sound hole 120; θ is the angle formed by the user to the first sound hole 110 and to the second sound hole 120; where θ ranges from 0 to 360 degrees; $k=\omega/c_0$, where ω is the sound wave frequency. According to the previous formulas, the sound received by the user has a shape of "∞". FIG. 6 shows a schematic shape of the sound received by the user who wears the earphone at his neck. The user's ear should be in the sound enhancement zone.

A third party 50 is positioned near the user 40. The sound emitted by the earphone has an attenuation zone and an enhancement zone. The front of the user 40 belongs to the enhancement zone, and the ears of the user 40 are in the enhancement zone, thus ensuring that the user 40 can clearly hear the sound played in the earphone. In addition, at the position of the third party 50, that is, on the side of the user 40, the distance of the cavity length of the resonant cavity 13 satisfies the above formula, and the sounds emitted by the first sound hole 110 and the second sound hole 120 have phase difference. The sounds emitted by the first sound hole 110 and the second sound hole 120 can be counteracted, thus disabling the third party 50 at the side of the user 40 to hear the sound clearly and effectively protecting the personal privacy of the user.

Furthermore, the resonant cavity 13 may also have a bent shape. According to the design requirements, the length of the resonant cavity 13 has to be longer as required. In order to keep the distance between the first sound hole 110 and the second sound hole 120 unchanged, the resonant cavity 13 is sometimes designed as bent to increase its length.

Figure 7:
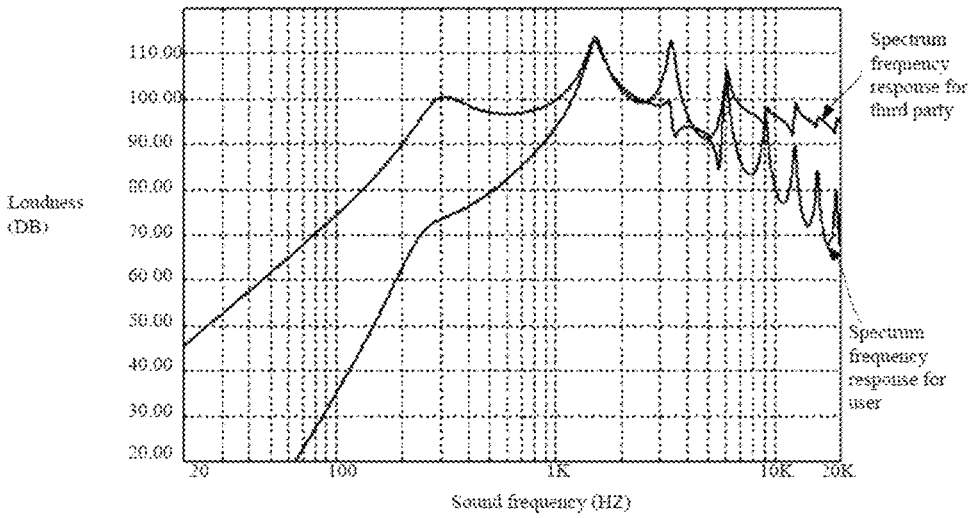
FIG. 7 is a schematic diagram of the spectrum response curve of the sound received by the user and the third party in FIG. 5.

As shown in FIG. 7, when using the earphones, responses of the user 40 and of the third party 50 to sound in the low frequency band are compared. It can be seen that the user 40 has a better response in the low frequency band. That is, the main range where human being receives the sound is the low frequency band. The low frequency range of sound is generally 20~200 HZ. That is to say, through the length of the resonant cavity 13, the sounds emitted from the first sound hole 110 and the second sound hole 120 are oriented to realize low-frequency superposition near the human ear, so that the sounds received by the human ear are clearer and the quality of the received sounds is improved. Further, sound should be canceled at the position of the third party 50 at the low frequency band, as to reduce the volume of the sound received by the third party 50. Thus the third party 50 cannot hear or clearly hear the sound emitted by the earphone, so as to protect the privacy of the user.

Furthermore, if the equivalent diameter of the resonant cavity 13 is R, then L>10R. The equivalent diameter R refers to a diameter of a circle who has a same cross-sectional area compared to an irregular object. After the distance L between the first sound hole 110 and the second sound hole 120 is determined, it is obtained that the equivalent diameter R is smaller than 10 percent of cavity length L. Such arrangement at least avoids the equivalent diameter R of the resonant cavity 13 from being too large to impact the quality of the transmitted sound.

In one embodiment, the earphone includes a partition (not labeled), which is arranged inside the housing 10. The partition and the inner wall of the housing 10 enclose to form a resonant cavity 13. Specifically, a partition space (not labeled) is arranged inside the housing 10, the partition is arranged inside the housing 10 to form the partition space, and the partition and the inner wall of the housing 10 jointly form the resonant cavity 13. The shape of the resonant cavity 13 can be decided by setting the shape of the partition as required. The housing 10 can be made of plastic, metal or wood. Furthermore, in order to ensure sound transmission quality, the material of the partition is the same as that of the housing 10. As such, the partition can be made of plastic, metal or wood.

Further, the partition includes a first portion 31 and a second portion 32, and a connecting portion (not labeled) connected to the first portion 31 and the second portion 32. The first portion 31, the second portion 32, the connecting portion, and the inner wall of the housing 10 jointly enclose to form the resonant cavity 13.

The first portion 31 is arranged adjacent to the first sound hole 110, and the second portion 32 is arranged adjacent to the second sound hole 120. For the first portion 31 and the second portion 32 are arranged corresponding to the first sound hole 110 and the second sound hole 120 respectively, it ensures that the first sound hole 110 and the second sound hole 120 are correspondingly arranged to the resonant cavity 13, and further ensures the sound emitted by the loudspeaker 20 can be accurately transmitted through the first sound hole 110 and the second sound hole 120.

Figure 8:
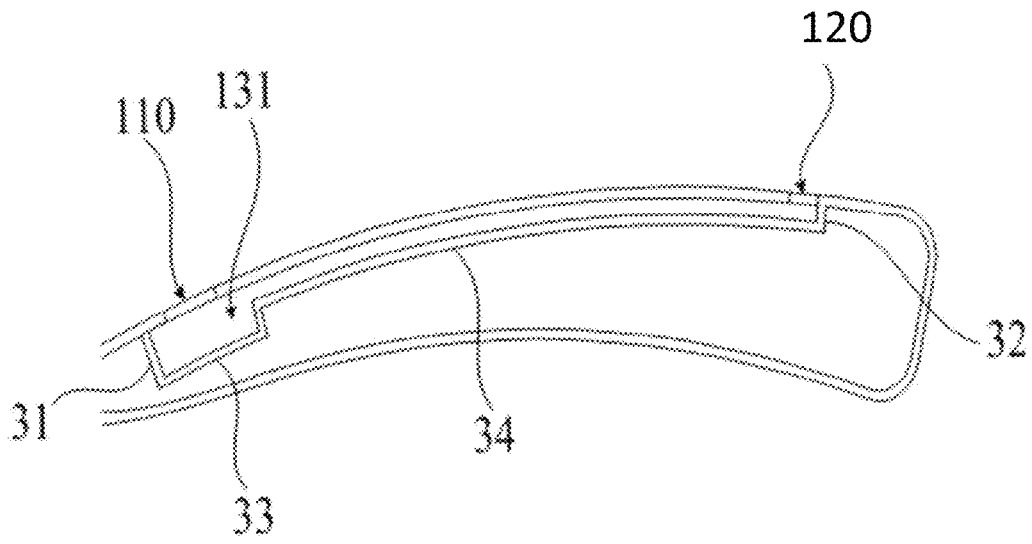
FIG. 8 is a structural schematic view of the installation room in FIG. 2.

As shown in FIG. 8, the first sound hole 110 and the second sound hole 120 are arranged on the upper surface of the housing 10. The connecting portion includes a first section 33 connected with the first portion 31 and a second section 34 connected with the second portion 32. The first portion 31 and the first section 33 form an installation space 131 for accommodating the loudspeaker. Generally speaking, when the loudspeaker 20 is installed in the housing 10, the loudspeaker 20 generally occupies a certain space. Therefore, it is necessary to set up an installation space 131 in the housing 10.

Further, the distance between the first section 33 and the inner top wall of the housing 10 is greater than the distance between the second section 34 and the inner top wall of the housing 10. It can be understood that the first section 33 is located farther away from the inner top wall of the housing 10. Put in another way, the installation space 131 has a relatively larger installation volume, so as to further meet the installation requirements of the loudspeaker 20. Further, it can be known that the second section 34 is relatively closer to the inner top wall of the housing 10. And the cavity cross-sectional area of the formed resonant cavity 13 is smaller. As such, the equivalent diameter of the resonant cavity 13 is prevented from being too large, and the sound is thus effectively transmitted in the resonant cavity 13.

Further, a length of the second section 34 is greater than that of the first section 33. Specifically, the sound emitted by the second sound emitting surface 22 of the loudspeaker 20 is transmitted through the resonant cavity 13. By setting the length of the second section 34 to be longer than that of the first section 33, the cavity length of the sound in the resonant cavity 13 corresponding to the second section 34 is ensured, thereby further increasing the propagation distance of the sound in the resonant cavity 13. As such, the sounds emitted by the first sound hole 110 and the sound emitted by the second sound hole 120 have a phase difference related to each other, and the user's ears are ensured to be at a sound-enhanced area.

In one embodiment, the housing 10 includes a housing body 11 arranged in an arc shape and installation sections 12 extending from both ends of the housing body 11 respectively. The first sound hole 110 and the second sound hole 120 are formed in the installation sections 12, and the resonant cavity 13 is formed in the installation sections 12. Generally, when a user enjoys music with the earphone, the earphone is worn at the neck of the user. The housing 10 includes a housing body 11 arranged in an arc shape, and the housing body 11 is hung at the neck of the user, which is perfectly in accordance to the ergonomic design.

Further, the installation sections 12 are extended from the housing body 11, and the installation contact between the earphone and the user is enlarged. The user can wear the earphone more firmly. Furthermore, the first sound hole 110, the second sound hole 120, and the resonant cavity 13 are all arranged in the installation sections 12, which means that the installation section 12 provides enough installation space.

Further, the first sound hole 110 is arranged at a position of the installation section 12 close to the housing body 11, and the second sound hole 120 is arranged at a position of the installation section 12 away from the housing body 11.

It can be understood that when the user wears the earphone, the first sound hole 110 is closer to the ear position of the user, and the second sound hole 120 is located in the front position facing the user. Thus, by setting the positions of the first sound hole 110 and the second sound hole 120, an enhancement zone of sound superposition and an attenuation zone of sound cancellation are formed in front of the user and in the ear position.

This is only some embodiments of the present disclosure and is not intended to limit the scope of the present disclosure. Any equivalent structural change made under the concept of the present disclosure using the contents of the present disclosure specification and drawings, or directly/indirectly applied in other related technical fields, shall be included in the protection scope of the present disclosure.

What is claimed is:

1. An earphone, comprising:

a housing defined with:

a first sound hole, a second sound hole, and a resonant cavity communicating the first sound hole and the second sound hole inside the housing; and a loudspeaker in the resonant cavity, including:

a first sound emitting surface corresponding to the first sound hole, and a second sound emitting surface opposite to the first sound emitting surface, wherein sound emitted from the second sound emitting surface is passed to the second sound hole through the resonant cavity, wherein the earphone has a partition inside the housing, the partition and an inner wall of the housing enclose and form the resonant cavity, the partition comprises a first portion, a second portion, and a connecting portion connecting the first portion and the second portion, the first portion, the second portion, the connecting portion, and the inner wall of the housing enclosing and forming the resonant cavity, and the first portion is disposed adjacent to the first sound hole, and the second portion is disposed adjacent to the second sound hole.

2. The earphone of claim 1, wherein a cavity length L of the resonant cavity satisfies: $L=(1+2k)*85/f$, wherein k is an integer, and f is an upper limit of a muffling frequency.

3. The earphone of claim 2, wherein an equivalent diameter of the resonant cavity is R, then L is larger than 10 times of R.

4. The earphone of claim 1, wherein the first sound hole and the second sound hole are on an upper surface of the housing, and the connecting portion comprises a first section connected with the first portion and a second section connected with the second portion, the first portion and the first section form an installation room for accommodating the loudspeaker.

5. The earphone of claim 2, wherein the first sound hole and the second sound hole are on an upper surface of the housing, and the connecting portion comprises a first section connected with the first portion and a second section connected with the second portion, the first portion and the first section form an installation room for accommodating the loudspeaker.

6. The earphone of claim 3, wherein the first sound hole and the second sound hole are on an upper surface of the housing, and the connecting portion comprises a first section connected with the first portion and a second section connected with the second portion, the first portion and the first section form an installation room for accommodating the loudspeaker.

7. The earphone of claim 4, wherein a distance from the first section to an inner top wall of the housing is greater than a distance from the second section to the inner top wall of the housing.

8. The earphone of claim 5, wherein a distance from the first section to an inner top wall of the housing is greater than a distance from the second section to the inner top wall of the housing.

9. The earphone of claim 6, wherein a distance from the first section to an inner top wall of the housing is greater than a distance from the second section to the inner top wall of the housing.

10. The earphone of claim 7, wherein a length of the second section is greater than a length of the first section.

11. The earphone of claim 8, wherein a length of the second section is greater than a length of the first section.

12. The earphone of claim 9, wherein a length of the second section is greater than a length of the first section.

13. The earphone of claim 1, wherein the housing comprises a housing body in an arc shape, and installation sections extending from two ends of the housing body, the first sound hole and the second sound hole being defined on each of the installation sections, and the resonant cavity being arranged in the installation sections.

14. The earphone of claim 13, wherein the first sound hole is defined at each of the installation sections close to the housing body, and the second sound hole is defined at each of the installation sections away from the housing body.

* * * * *